US005157443A

United States Patent [19]

Anderson et al.

[11] Patent Number: 5,157,443

[45] Date of Patent: Oct. 20, 1992

[54] MOVING BELT LIQUID DEVELOPMENT METHOD AND DEVICE

[75] Inventors: Harold M. Anderson; Stephen T. Chai, both of Rancho Palos Verdes, Calif.; Vittorio R. Castelli, Yorktown Heights; Gerald A. Domoto, Briarcliff Manor, both of N.Y.

[73] Assignee: Xerox Corporation, Stamford, Conn.

[21] Appl. No.: 764,286

[22] Filed: Sep. 23, 1991

[51] Int. Cl.[5] ..... G03G 15/10

[52] U.S. Cl. ..... 355/256; 118/659; 118/660; 355/245; 355/269

[58] Field of Search ..... 118/659-662; 355/245, 256, 269; 430/117, 118

[56] References Cited

U.S. PATENT DOCUMENTS

| | | | |
|---|---|---|---|
| 3,669,073 | 6/1972 | Savit et al. | 355/256 X |
| 3,910,231 | 10/1975 | Inoue et al. | 355/259 X |
| 3,949,703 | 4/1976 | Smith et al. | 355/256 X |
| 4,410,260 | 10/1983 | Kuehnle | 355/10 |
| 4,796,048 | 3/1989 | Bean | 355/3 TR |
| 4,851,317 | 7/1989 | Chuang et al. | 118/662 X |
| 4,878,090 | 10/1989 | Lunde | 355/256 |
| 4,883,018 | 11/1989 | Sagiv | 118/660 |
| 4,907,532 | 3/1990 | Mikelsons et al. | 118/659 |
| 4,918,487 | 4/1990 | Coulter, Jr. | 355/256 |
| 4,994,860 | 2/1991 | Lunde et al. | 355/256 |
| 5,053,824 | 10/1991 | Schram | 355/259 |
| 5,120,630 | 6/1992 | Wadlo | 355/256 X |

*Primary Examiner*—A. T. Grimley
*Assistant Examiner*—Matthew S. Smith
*Attorney, Agent, or Firm*—Robert A. Chittum

[57] ABSTRACT

A method and apparatus is disclosed for an improved liquid development system for a high speed reproducing machine having a movable image retention belt. The liquid development system comprising a moving belt applicator mounted on a drive assembly containing at least one drive roll and a low lateral force roll with a position guide. The belt applicator is located in alignment with the image retention belt and spaced therefrom to form a development zone having a uniform gap with an extended length. The applicator drive roll and a low lateral force roll are positoned to transport the belt applicator in the same or opposite direction as the image retention belt, but at a much faster speed to facilitate an evenly distributed flow of liquid developer and to avoid depletion of toner particles from the liquid developer moved through the development zone. An air knife removes excess liquid developer from the developed image on the image retention belt, and a blade cleaner is used to clean the belt applicator after it passes the development zone.

17 Claims, 3 Drawing Sheets

MOVING BELT LIQUID DEVELOPMENT METHOD AND DEVICE

BACKGROUND OF THE INVENTION

1. Field of the Invention

This invention relates generally to liquid development of latent images on electrographic or electrophotographic recording members. More particularly, the invention relates to a liquid development of latent images produced on a movable image retention belt for high speed reproducing machines by using a moving belt applicator to define a development zone having a uniform gap with an extended length.

2. Description of the Prior Art

Electrographic printers form electrostatic latent images on a dielectric surface of a conductive belt of drum by means of an ion deposition process. This process records the informational areas contained on an original document or encoded in digital form. The latent image is developed by bringing a developer material in contact with it. The developer consists of a liquid carrier containing dispersed pigmented toner particles. The toner particles are deposited in image configuration onto the dielectric surface of the conductive member, after which the developed image is transferred to a copy sheet. After transfer, heat is applied to the copy sheet to permanently fuse the toner particles, and the dielectric surface of the conductive member is cleaned for another electrostatic latent image. In electrophotographic printers, an electrostatic charge is placed uniformly over a photoconductive surface of a conductive belt or drum and the charge photoconductive surface is moved past an exposure station, where a flowing light image of an original document or encoded digital information is imaged thereon. An imaging operation at the exposure station selectively dissipates the charge on the photoconductive surface in the light exposed region, thereby recording the original document or digital data thereon in the form of a latent electrostatic image. The remainder of the electrophotographic printing process is similar to the above-described electrographic printing process. Existing methods for developing latent images of charged areas on image retention members with liquid developers consist generally of two types; namely fountain developers and rolling cylinder developers. Fountain developers force a liquid developer through a small channel up to a lip spaced from an image retention member to form a development gap height. The liquid developer is then returned to a liquid sump by gravity or vacuum. Many variations of this fundamental configuration exist, but they suffer from a number of difficulties. The channels through which the liquid developer must pass are necessarily quite thin and they are subject to being narrowed and even blocked by liquid developer adhesion to the walls of the channel. This condition would be further aggravated if a developmental bias is used to reduce background noise in the developed image. Development of latent images in high speed printers or reproducing machines would require many channels through which the liquid development would be forced to flow the liquid developer against the latent images.

Rolling cylinder developers pull liquid developer into the development gap by surface tension and viscous drag. The only narrow channel is in the development gap between the rolling cylinder and the image retention member. A development bias voltage may be effectively employed to reduce background, but the large development gap at the leading edge of the meniscus introduces a much weaker field than exists at the narrowest part of the developmental gap. This variation in the gap distance adversely influences the development of the latent image. The length of the development gap is limited by the geometry of the rolling cylinder and the image retention member. For high speed applications, many such rolling cylinders must be used in tandem.

A significant problem encountered in liquid development apparatus is that the developer comprises a liquid carrier with entrained toner particles and the liquid developer in contact with latent images tend to become void of toner particles in the vicinity of the latent images. This may occur even after a very short period of time, since the concentration of toner particles in the liquid near where the developer is brought into contact with the image retention member may be lowered very rapidly when developing a latent image having a large solid area. As processing speeds for electrographic and electrophotographic machines increased, liquid development apparatus required modifications to keep pace with the increased throughput. It was found that as the image retention member was passed over a rotating cylindrical developer, the developing zone was relatively small and that effective development was limited by the volume of liquid developer that the rotating cylindrical developer could deliver to the processing nip. Similarly, for high speed development, the fountain developers required many more channels through which the ink was forced to flow in a fountain-like fashion.

U.S. Pat. No. 4,907,532 to Mikelsons et al. discloses a development apparatus for the application of liquid toner to the surface of a cylindrical electrophotographic image receptor bearing a latent image. A liquid development apparatus comprising an endless belt electrode is tensioned between two rollers and positioned to be driven orthogonally with respect to the movement of the receptor. The geometrical positioning of the belt with respect to the receptor produces a developmental zone defined by the width of the endless belt electrode and the gap between the belt electrode and the receptor. In this configuration, the endless belt electrode is parallel with the axis of rotation of the cylindrical receptor and perpendicular to the direction of rotation of the receptor. In an alternate embodiment, the span of belt electrode forming the development zone is magnetically shaped in a base support member to provide a uniform development gap between the belt electrode and the cylindrical receptor. Liquid toner from a continuous supply of toner is forced into the development zone by supply channels and return channels. In one embodiment, the supply channel is a series of holes spaced along the base support member and slots are formed in the endless belt electrode to allow the liquid toner to flow into the development zone between the belt and the cylindrical receptor. The liquid toner is extracted from the development zone be means of return passageways on either side of the belt. Extraction of the liquid development is accomplished by a source of vacuum which pulls the liquid developer into and through the return passageways.

U.S. Pat. No. 4,410,260 to Kuehnle discloses method and apparatus for liquid development using an endless electrophotographic belt with a photoconductive surface on its exterior surface. The belt is mounted on two rollers and the bottom reach is charged and imaged as the belt moves in one direction. When the belt passes the development station, a cylindrical development roller applies liquid toner from a sump to the latent image. The development roller protrudes into the belt causing it to wrap around a portion of the periphery of the development roller for the purpose of producing a narrow gap between the belt and the development roller. The purpose of the electrophotographic belt wrapping around a portion of the development roll is to extend the development zone. However, unless annular collars are used to provide a uniform spacing of the electrophotographic belt from the development roll the development zone would be a complex function of the relative speed of the two elements, the compliance of the electrophotographic belt, the tension of the electrophotographic belt, and the viscosity of the developer. Thus, without the annular collars the layer of developer about the surface of the development roll would not help a uniform thickness along the axis of the development roll.

U.S. Pat. No. 4,883,018 to Sagiv discloses a fountain-type liquid development system to develop latent images on a planar image retention member. The image retention member is a flexible belt that moves in a direction opposite to the direction of gravitational forces exerted on it. An extended development zone is formed such that it is parallel to the surface possessing the latent image. The liquid developer material is pumped from a sump into the development zone and then circulated back to the sump.

U.S. Pat. No. 4,796,048 to Bean discloses a resilient intermediate transfer member and apparatus for liquid ink development. A conventional liquid development system develops latent images on an electrophotographic drum and the developed images are transferred to an intermediate belt by a biased transfer roll. The developed images are then transferred from the intermediate belt to a copy sheet which is then passed through a fuser to permanently fix the developed images thereon.

U.S. Pat. No. 4,918,487 to Coulter, Jr. discloses method and apparatus for applying liquid toner to very small areas of a recording surface used in high speed micro imagery applications. The method includes a photoconductor disposed over a conductive substrate and having at least one fractional area containing a latent image that is to be developed. A flexible belt having a dielectric layer on its own conductive substrate acts as a carrier mechanism. Liquid toner is electrostatically deposited on the carrier member to form a predeposit of desired density in an area corresponding to the fractional area to be developed on the photoconductor. The transfer of toner is accomplished by a pair of plungers. When engaged, contact is made between the predeposit on the flexible belt and the fractional area on the photoconductor containing the latent image.

SUMMARY OF THE INVENTION

It is an object of the present invention to provide a moving belt liquid development station that ensures an evenly distributed flow of liquid developer through a development zone at speeds well in excess of the speed of the latent image retaining member.

In the present invention, an improved liquid development system for a high speed reproducing machine having a movable image retention belt is described wherein a moving belt applicator is mounted on a drive assembly containing at least one drive roll and a low lateral force roll with a position guide. The belt applicator is located in alignment with the image retention belt, but spaced therefrom to form a development zone having a uniform gap with an extended length. The applicator drive roll and low lateral force roll are positioned to transport the belt applicator in the same or opposite direction as the image retention belt, but at a much faster speed to facilitate an evenly distributed the flow of liquid developer and to avoid depletion of toner particles from the liquid developer which is moved through the development zone. An air knife removes excess liquid developer from the developed image on the image retention belt, and a blade cleaner is used to clean the belt applicator after it passes the development zone.

A more complete understanding of the present invention can be obtained by considering the following detailed description in conjunction with the accompanying drawings wherein like parts have the same index numerals.

DESCRIPTION OF THE PREFERRED EMBODIMENT

Figure 1:
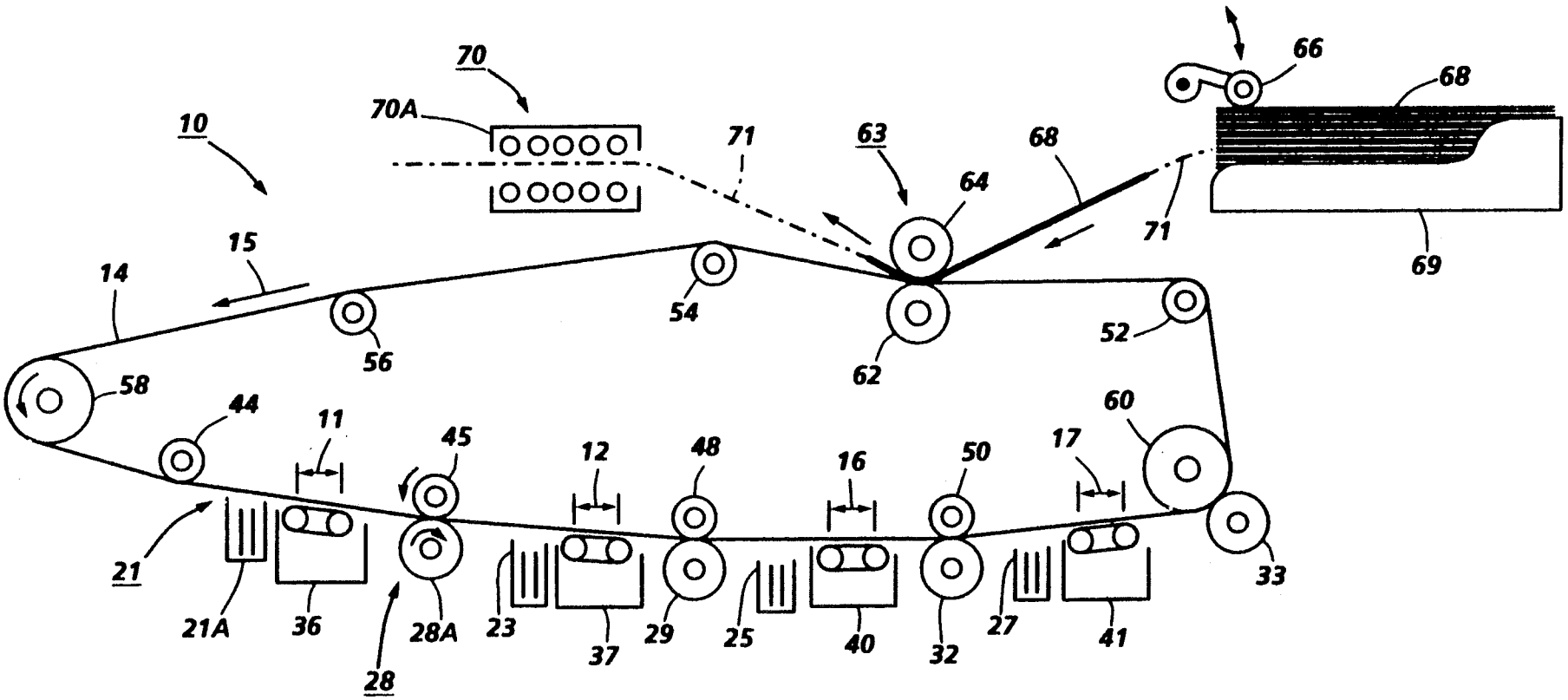
FIG. 1 is a schematic cross-sectional, elevation view showing an illustrative multi-color electrographic printing machine incorporating a plurality of liquid development apparatus of the present invention therein.

FIG. 1 illustrates a high speed multi-color electrographic or ionographic printer 10 in diagram form, with the printer housing and framework omitted. Insomuch as the art of electrographic printing is well known, the various processing stations employed in the printer in FIG. 1 are shown schematically and their operation described briefly with reference thereto. Though the liquid development method and apparatus of the present invention is suitable for development of latent images in either electrographic, ionographic or electrophotographic devices, a high speed multi-color ionographic printer has been chosen for the operating environment.

Turning now to FIG. 1, this ionographic high speed color printer 10 employs, as an image retention member, an endless conductive belt 14 having a dielectric covering or layer (not shown) on which surface multiple latent electrostatic images are created by means of an ion deposition process. Belt 14 moves in the direction of arrow 15 to advance successive portions of its surface through the various processing stations disposed about the path of movement at a speed of at least 10 inches/-second. Belt 14 is supported by three rollers 58, 60 and 52. Roller 58 is rotatively driven by a suitable motor (not shown) to move belt 14. Rolls 44, 45, 48, 50, 54 and 56 are idler rolls provided to keep the belt 14 taut and on track.

Initially, a portion of belt 14 passes through the primary color charging station 21, where an image forming ion deposition subsystem 21A deposits charges in sufficient magnitude to form latent images on the dielectric surface of belt 14, and then belt 14 passes the first moving belt liquid development system 36 with the dielectric belt surface containing the latent image confronting, but being uniformly spaced therefrom, to form a development zone 11 described later with respect to FIG. 2. The first development system advances a developing liquid (not shown) comprising an insulating carrier liquid containing a predetermined concentration of toner particles into the development zone 11 to develop the electrostatic latent image recorded on belt 14 and render it visible by means well known in the art. The carrier liquid is removed from belt 14 at a blotting station 28 which includes blotting roller 28A. The blotting roller is covered by an appropriate absorbent material and is driven by separate electric motor or by timing belt and pulley (neither shown) from the drive motor for belt drive roller 58 in the same direction and speed as that of belt 14 to prevent disturbing the developed image while removing the carrier liquid.

Next, belt 14 is advanced to the second primary charging station 23 for deposition of an electrostatic latent image of the second primary color, development station 37 with its development zone 12, and blotting roll 29. The processes are same as those indicated for the first primary color. Belt 14 moves on to the third primary color charging station 25 for deposition of the latent image of the third primary color, development station 40 with its development zone 16 and blotting roll 32. At charging station 27, belt 14 is charged for a latent image for the color of black where alphanumeric text and other black graphic information are generally formed. Black liquid toner is applied by the moving belt development station 41 with development zone 17. Carrier liquid is blotted from the belt 14 by blotting roll 33. After the final color development, belt 14 advances the developed full color image to transfer station 63 where a sheet of copy paper 68 is advanced from a stack located in tray 69 along path 71 by sheet feeder 66. A copy paper advances in synchronism with the movement of the developed full color image on belt 14 so as to arrive therewith at the transfer station 63, generally indicated by transfer rolls 62 and 64. After transfer, the copy sheet continues to move to a fusing station 70. The fusing station includes a fusing system consisting of, for example, a radiant fuser 70A which vaporizes any liquid carrier transferred to the copy sheet and permanently fuses the toner particles in image configuration thereto. Upon completion of fusing, the copy sheet is advanced to a catch tray (not shown) for subsequent removal from the printer.

Figure 2:
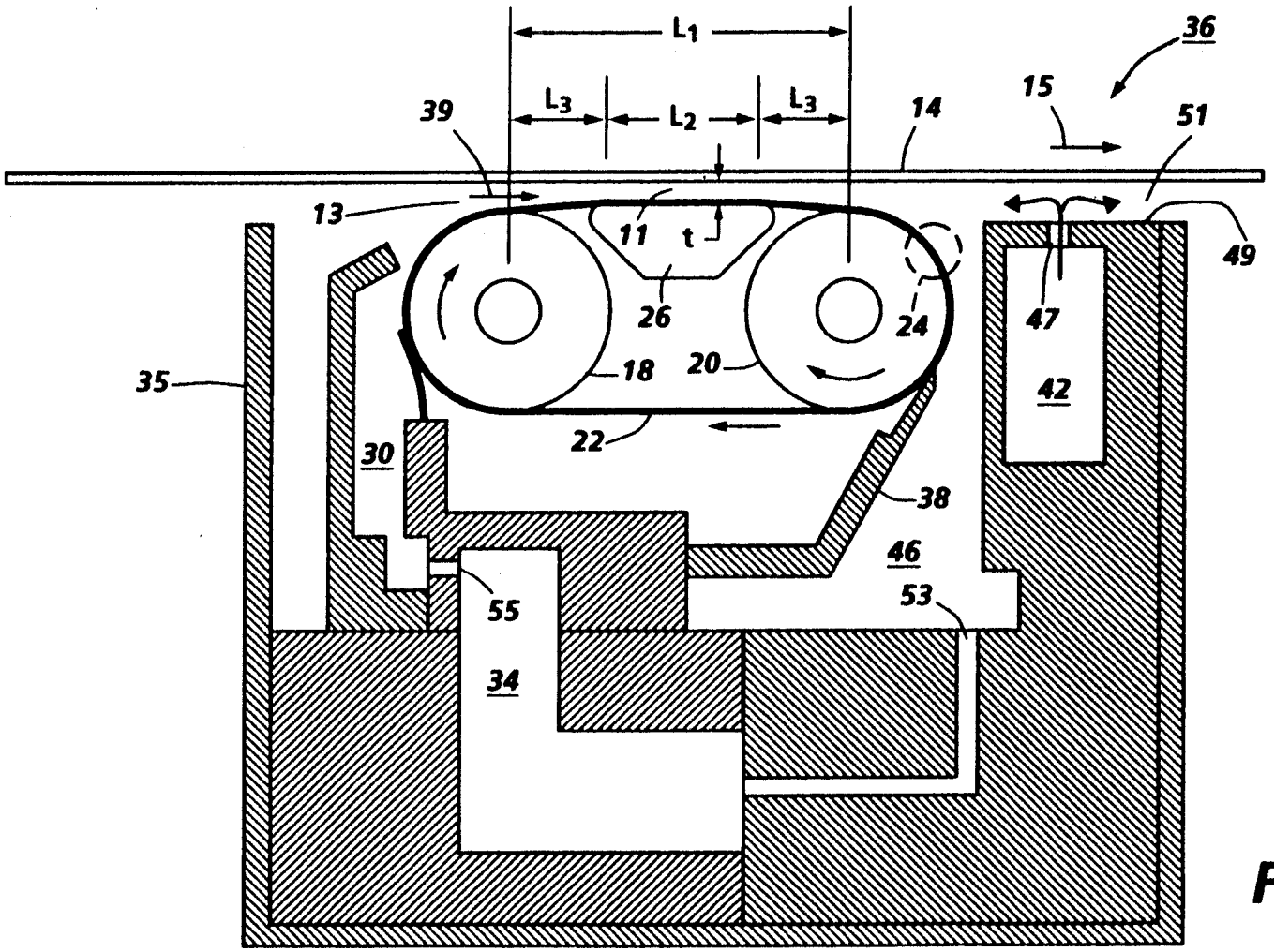
FIG. 2 is a schematic cross-sectional view of one of the liquid development apparatus shown in FIG. 1.

FIG. 2 illustrates an enlarged schematic cross-sectional view of the liquid development station 36 shown in FIG. 1. Since all of the development stations of the multi-color ionographic printer are identical, except for the color of the liquid developer, a detailed description of development station 36 will describe the present invention. A development station includes a driven roll 18 and a low lateral force roll 20, discussed later, on which the belt applicator 22 is mounted, all of the which are surrounded by a housing 35 open at the top in order to expose the upper span of the belt applicator. The rolls 18, 20 have a diameter of about one inch and are positioned so that the belt applicator 22 is moved in the same or opposite direction as the image retention belt 14. The exposed upper belt span of the belt applicator is maintained in uniformly spaced parallel operative proximity to the image retention belt 14, generally forming a gap "t" on the order of 200 to 500 micrometers to form the development zone 11 having an extended length as "$L_1$". The development zone has a width equal to the width of the image retention belt, which in the preferred embodiment is 8 to 11 inches or a pagewidth and the length, which is in the process direction or moving direction of the image retention belt, is determined by the center-to-center spacing of the driven roll 18 and low lateral force roll 20. The center-to-center spacing of the rolls are generally about 2 to 3 inches. The belt applicator is driven by a constant speed motor (not shown) drivingly connected to the driven roll 18. The belt applicator speed is about 2 to 3 times the process speed of the image retention belt which is 10 inches/-second. Therefore, the speed of the bely applicator is about 20 to 30 inches/second. In the preferred embodiment, the upper span of the belt applicator between the rolls 18, 20 is moved in the same direction as the portion of the confronting lower span of the retention belt, though movement of the belt which travels through the development station 36 applicator in the opposite direction will work if the liquid developer entrance 13, discussed below, is reversed to be adjacent roll 20. The faster speed of the belt applicator relative to the image retention belt, combined with its direction of movement, indicated by arrow 39, being in the same direction as the image retention belt, indicated by arrow 15, and combined with the extended length development zone having a uniform gap t provides enhanced ability of the liquid development station to develop latent images at a much higher process speed than heretofore known. This is because the toner particle concentration of the developer is maintained more constant and they are kept in the vicinity of the force fields of the electrostatic latent images for a relatively longer period of time.

Optionally, a gap defining shoe 26 is provided between the rolls 18 and 20 and slidingly positioned against the bottom surface of the upper span of the image retention belt to precisely define and ensure the uniform height of the development zone. When the gap defining shoe 26 is used, the extended length of the development zone 11 has three zones, one of precise uniform thickness for the length of the shoe as indicated by "$L_2$"and the other two on opposite ends thereof as indicated by "$_3$". $L_2$ is shorter than $L_1$ by the distance equal to twice the radius ($L_3$) of the rolls 18, 20, so that if $L_3$ is ½ inch, then $L_2$ equal 1 to 2 inches. In this optional configuration, however, development liquid is available in the slightly thicker gap region of $L_3$.

The liquid developer is brought into the entrance 13 of the development zone by a pump (not shown) or, in an alternate embodiment (not shown), the belt applicator is partially submerged in a liquid developer and the liquid developer is brought into the entrance of the development zone by viscous drag. In either embodiment, the liquid developer, after it reaches the entrance 13, is dragged through the development zone rather than being pumped through under pressure or sucked through under a vacuum. The movement through the development zone by the viscous drag at speeds well in excess of the speed of the image retention belt facilitates an evenly distributed flow through the development zone and avoids the problem of variable toner particle concentration across the width of the development areas so prevalent in prior art liquid development systems.

Because short, closed-loop belt systems, such as used in this invention, are difficult to guide, a low lateral force roll 20 is used together with a spring biased edge guide 24 (shown in dashed line) on one or both sides thereof. A low lateral force roll is one in which the lateral stiffness, i.e., the stiffness in the direction of the axis of the roll, is significantly lower than its radial stiffness. Such a roll is constructed of an elastomeric layer on, for example, a metal roll, which has parallel grooves for forming circular flanges having low lateral or side-to-side stiffness. A typical edge guide 24 comprises a flat, annular member (not shown) rotatably mounted to rotate about an axis parallel with the axis of rotation of the low lateral force roll and in contact with the belt applicator portion wrapped therearound. The annular member may be any bushing material compatible with the liquid developer, such as, for example, Teflon ®. The annular member is spring biased along its axis in a direction toward the belt applicator to keep it from walking off the low lateral force roll laterally.

Figure 3:
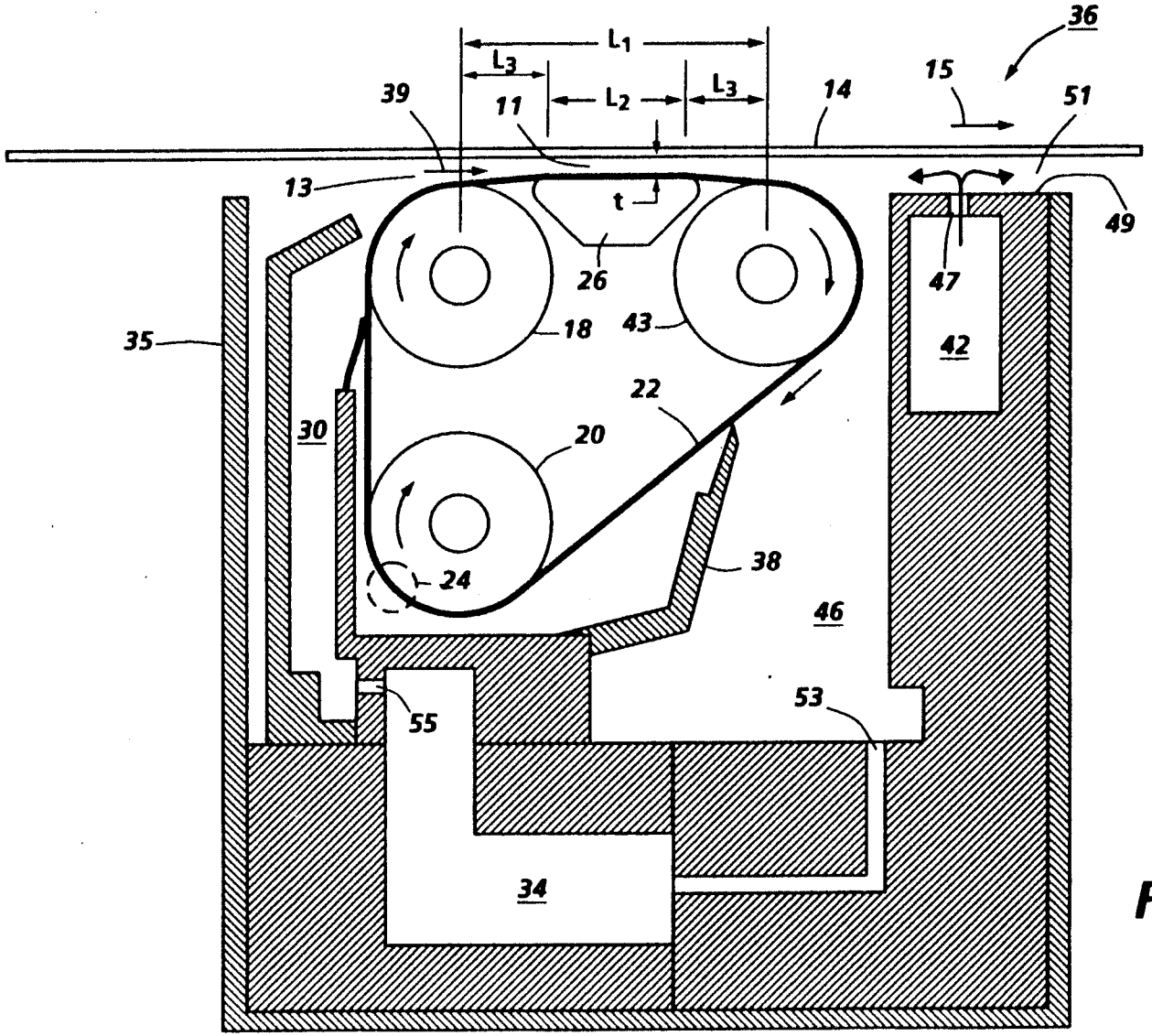
FIG. 3 is a schematic cross-sectional view of an alternate embodiment of the liquid development apparatus of the present invention.

An alternate embodiment is shown in FIG. 3, wherein the low lateral force roll 20 in FIG. 2 has been relocated below the driver roll 18 and a new idler roll 43 has been added at the former location of the low lateral force roll 20, so that the belt applicator 22 is mounted on three rolls instead of two. The embodiment of FIG. 3 is otherwise substantially the same as FIG. 2.

Wiper blade 38 scrapes off any toner particles which adhere to the belt applicator, so that development of the latent image is enhanced because the electrostatic attraction of the latent image does not have to compete with forces causing the toner particles to adhere to the belt applicator. The wiper blade 38 also divides the development station into a developer supply chamber 34 and a developer return chamber 46. The liquid developer in the return chamber is reconstituted by adding toner particles and liquid carrier thereto, as required, and returned to the supply chamber by passageway 53 where the ink is mixed prior to entering the input channel 30 through opening 55, where in the preferred embodiment, it is pumped up to the entrance 13 of the development zone 11. When the printer is off or not printing, the supply of developer to the input channel is cut off by stopping the developer pump (not shown), so that the developer is removed from the development zone to prevent inadvertent attraction or plating on of toner particles on the image retention belt which would cause upwanted background or blotting of subsequently developed images.

On the downstream side of the development zone of either embodiment, air is forced from air chamber 42 under a pressure 1 psi normal to the surface of the image retention member 14 containing the developed image through a slot 47 in chamber upper wall 49 to form an air knife similar to that disclosed in co-pending, commonly assigned, U.S. application Ser. No. 07/560,814 to Gerald A Domoto et al., entitled "Removal of Excess Liquid From an Image Receptor", filed Jul. 31, 1990 and incorporated herein by reference. Upper wall 49 is parallel to the image retention belt and closely adjacent thereto to form a narrow passageway 51 which channels the air through the passageway in a direction parallel to the image retention member to form an air knife which removes any excess carrier liquid, leaving substantially only the toner particles and requiring minimal subsequent carrier liquid removal by the blotting roll 28A (FIG. 1). Passageway 51 has a uniform gap between the image retention belt and chamber upper wall of 1 to 5 mils and preferably about 3 mils.

Many modifications and variations are apparent from the foregoing description of the invention, and all such modifications and variations are intended to be within the scope of the present invention.

We claim:

1. A liquid development apparatus for developing latent images on the surface of a moving belt image retention member of a reproducing machine, comprising:

an endless belt applicator mounted on and tensioned between at least two support rolls and driven in a predetermined direction relative to the direction of the moving belt image retention member, the belt applicator being positioned with respect to the belt image retention member such that a portion of the belt applicator is parallel to and uniformly spaced from the belt image retention member by a predetermined gap, so that an extended development zone is provided with a predetermined length and has a developer entrance and exit which will move a liquid developer therethrough by viscous drag;

means for driving the belt applicator at a predetermined speed faster than the speed of movement of the belt image retention member;

a housing surrounding the belt applicator and said at least two support rolls and containing a supply of liquid developer comprising a carrier liquid and pigmented toner particles;

means for continuously moving liquid developer into the entrance of the development zone so that the liquid developer is rapidly transported through the development zone and thereby develop any latent images on the confronting belt image retention member;

a scraper blade for removing liquid developer from the belt applicator downstream from the development zone; and an air knife for removing carrier liquid from the developed image on the belt image retention member emerging from the development zone.

2. The liquid development apparatus of claim 1, wherein the predetermined gap between the belt applicator and belt image retention member is 200 to 500 micrometers.

3. The liquid development apparatus of claim 2, wherein the predetermined length of the extended development zone is 2 to 3 inches.

4. The liquid development apparatus of claim 3, wherein support rolls on which the belt applicator in mounted have a diameter of about 1 inch.

5. The liquid development apparatus of claim 4, wherein the belt applicator is driven at a speed of 2 to 3 times the speed of the image retention member.

6. The liquid development apparatus of claim 5, wherein the speed of the image retention member is 10 inches/second, and wherein the speed of the belt applicator is 20 to 30 inches/second.

7. The liquid development apparatus of claim 5, wherein one of the support rolls is driven and the other support roll is a low lateral force roll.

8. The liquid development apparatus of claim 7, wherein the low lateral force roll has an edge guide which prevents the belt applicator from walking off the low lateral force roll in lateral direction.

9. The liquid development apparatus of claim 5, wherein the belt applicator is mounted on and tensioned between three support rolls, one support roll is driven, a second support roll is an idler roll, and the third roll is a low lateral force roll, the belt applicator portion between the driven support roll and the idler support roll is parallel to the image retention member and forms the extended development zone with predertermined uniform gap, and the low lateral force roll is positioned below the driven support roll; and wherein the low lateral force roll has an edge guide which prevents the belt applicator from walking off the low lateral force roll in the lateral direction, thus keeping the belt applicator centered on the support rolls.

10. The liquid development apparatus of claim 5, wherein the air knife is formed by expelling air under a pressure of about 1 pound/square inch (psi) in a direction normal to the image retention member from a slit in an upper wall of an air chamber located downstream from the extended development zone, the air chamber upper wall being parallel to the image retention member to form a uniform gap therebetween, so that substantially all of the carrier liquid is removed.

11. The liquid development apparatus of claim 1, wherein the predetermined direction in which the belt applicator is driven is the same direction as that of the moving belt image retention member.

12. The liquid development apparatus of claim 1, wherein the predetermined direction in which the belt applicator is driven is the opposite direction as that of the moving belt image retention member.

13. A method of developing latent images on a moving belt image retention member of a reproducing machine, comprising the steps of:

(a) providing an extended development zone having a predetermined length and uniform predetermined gap by positioning a belt applicator tensioned between at least two support rolls adjacent the belt image retention member;

(b) driving the belt applicator in a predetermined direction relative to the direction that the moving belt image retention member is traveling and a speed faster than said belt image retention member;

(c) supplying liquid developer continuously to the development zone which moves the liquid developer therethrough by viscous drag and develops latent images on the belt image retention member;

(d) removing the liquid developer from the belt applicator with a scraper blade after the belt applicator exits from the development zone; and (e) removing excess liquid developer from the developed latent images as they exit from the development zone with an air knife.

14. The method of developing latent images of claim 13, wherein the predetermined length and uniform gap of the extended development zone are 2 to 3 inches and 200 to 500 micrometers, respectively.

15. The method of developing latent images of claim 14, wherein belt image retention member travels at a speed of 10 inches/second, and wherein the belt applicator speed is 20 to 30 inches/second.

16. The method of developing latent images of claim 13, wherein the predetermined direction in which the belt applicator is driven in step (b) is in the same direction as that of the moving belt image retention member.

17. The method of developing latent images of claim 13, wherein the predetermined direction in which the belt applicator is driven in step (b) is in the opposite direction to that of the moving belt image retention member.

* * * * *